United States Patent [19]

von Klinggraff et al.

[11] 4,183,700

[45] Jan. 15, 1980

[54] WALKING MINE SUPPORT

[75] Inventors: Gerhard von Klinggräff, Neukirchen-Vluyn; Karlheinz Bohnes, Bochum; Heinz Kunzer, Herne; Peter Marr, Bochum, all of Fed. Rep. of Germany

[73] Assignee: Bochumer Eisenhutte Heintzmann GmbH, Bochum, Fed. Rep. of Germany

[21] Appl. No.: 948,324

[22] Filed: Oct. 4, 1978

[30] Foreign Application Priority Data

Oct. 8, 1977 [DE] Fed. Rep. of Germany ..... 2745429

[51] Int. Cl.[2] ..... E21D 15/44

[52] U.S. Cl. ..... 405/291

[58] Field of Search ..... 405/291-301; 299/31-33; 91/170 MP; 248/357

[56] References Cited

U.S. PATENT DOCUMENTS

| | | | |
|---|---|---|---|
| 3,447,328 | 6/1969 | Schuermann | 405/291 |

FOREIGN PATENT DOCUMENTS

| | | | |
|---|---|---|---|
| 2549941 | 5/1977 | Fed. Rep. of Germany | 405/291 |
| 1308267 | 9/1962 | France | 405/291 |
| 1013615 | 12/1965 | United Kingdom | 405/291 |
| 1125325 | 8/1968 | United Kingdom | 405/291 |

*Primary Examiner*—Dennis L. Taylor
*Attorney, Agent, or Firm*—Michael J. Striker

[57] ABSTRACT

A walking mine support includes a roadway support unit and a face-gallery support unit laterally of the same. The two units are linked by one or more four-pivot couplings whose members can tilt both lengthwise and transversely of the elongation of the roadway and permit walking movements of the units with reference to one another without interfering with proper support of either the roadway or the face-gallery.

8 Claims, 3 Drawing Figures

WALKING MINE SUPPORT

BACKGROUND OF THE INVENTION

1. Field of the Invention

The present invention relates to longwall mining in general.

More particularly, the invention relates to walking mine supports, and specifically to devices of this type which support the transitional area between road (gallery) and face.

2. The Prior Art

Longwall mining is well known. A review of the techniques employed and the equipment used may be found in U.S. Bureau of Mines Information Circular 8740, to which reference may be had for background information.

Basically, coal-mining equipment in longwall mining moves in a roadway (gallery) along a mine face from which coal is removed and transported away along the roadway. The roadway is supported by longitudinally spaced stationary supports each having uprights at opposite sides of the roadway and a lintel-type roof shield. The coal at the face is often so located that it must be removed by undercutting the face, i.e. by removing coal along the lower part of the face which leaves an overhang. This overhang, including the part of the face which merges with the roof of the adjacent roadway, must be supported against collapse. Also, since during passage of the coal-mining equipment the uprights of the stationary supports must be temporarily removed at the mine-face side of the roadway, the transitional area between roadway and face must similarily be supported by auxiliary supporting equipment.

For purposes of such support it is known to provide auxiliary supporting equipment which, heretofore, was a type that could be clamped, bolted or otherwise connected to the roadway supports. This equipment includes e.g. supporting shields and other elements which are braced from below by pit props. As coal removal progresses along the mine face, this equipment must frequently be disassembled, moved along the mine face to new locations and be reassembled. Given the relative frequency of such moves and the relatively large member of components involved in assembly and disassembly, it is clear that such operation are time-consuming and highly labor-intensive. Moreover, the frequent moves tend to change the equilibrium of the overburden so that disassembly and reassembly of the equipment usually requires the ability to make on-the-spot improvisation to accommodate for unexpected or changing conditions. This, in turn, means that the operations must be carried out by skilled miners, rather than by auxiliary personnel, and makes the whole procedure even more costly. In addition, damage to the various components, as well as to the coal-mining and coal-conveying equipment and to the roadway supporting equipment, is almost unavoidable. This is costly and, in the case of damage to the roadway supports, makes it even more difficult to carry out the assembly and disassembly operations.

The seam area of the face adjacent the roadway (i.e. the aforementioned transitional area) is also the area in which the drive equipment for the coal-mining and coal-conveying machines is located. This is the reason for the need to remove the stationary uprights while this equipment passes through. Because of this it has heretofore been customary to temporarily support this transitional area by means of individual hydraulic pit props which, in effect, define a kind of travelling buffer zone between the face and the roadway supports. The term "travelling" here denotes the fact that after the mining equipment has passed a given location, the pit props are moved along with it and in the vacated location the stationary uprights are reinstalled. Again, the release and resetting of these pit-props is carried out manually. Aside from the cost and the loss of time involved, the setting of these props (and the effectiveness of support offered by them) is directly dependent on the skill and care of the miners who are entrusted with this job. Any human error thus necessarily increases the danger of cave-ins. Also, the frequent removal of the props tends to cause loosening of the rock strata of the overburden in the transitional area between face and roadway.

A proposal has been made to provide a supporting arrangement for this transitional area which was to be coupled to and move with a face support and a walking roadway support. However, this could not be employed in practice because severe damage was constantly being sustained and also because it was incapable of accommodating itself to the constantly changing conditions of the surrounding strata.

SUMMARY OF THE INVENTION

Accordingly, it is an object of the invention to overcome the disadvantages of the prior art.

A more particular object is to provide a walking mine support which avoids these disadvantages and capable of providing requisite support for the face at all times, as well as being readily able to cooperate with a seam support while allowing for the possibility that both supports may be advancing at different times and/or rates.

In pursuance of these objects, and of still others which will become apparent hereafter, one aspect of the invention resides in a walking mine support of the type under discussion. Briefly stated, this support may comprise a walking roadway support unit adapted to support at least the roof of the roadway and adapted to advance lengthwise of the latter; a walking face gallery support unit adapted to support the roof of the face gallery and also adapted to advance lengthwise of the roadway; and at least one form-pivot coupling connecting the units with one another and comprising coupling members which are tiltable about mutually inclined axes extending lengthwise of and transverse to the elongation of the roadway, respectively.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
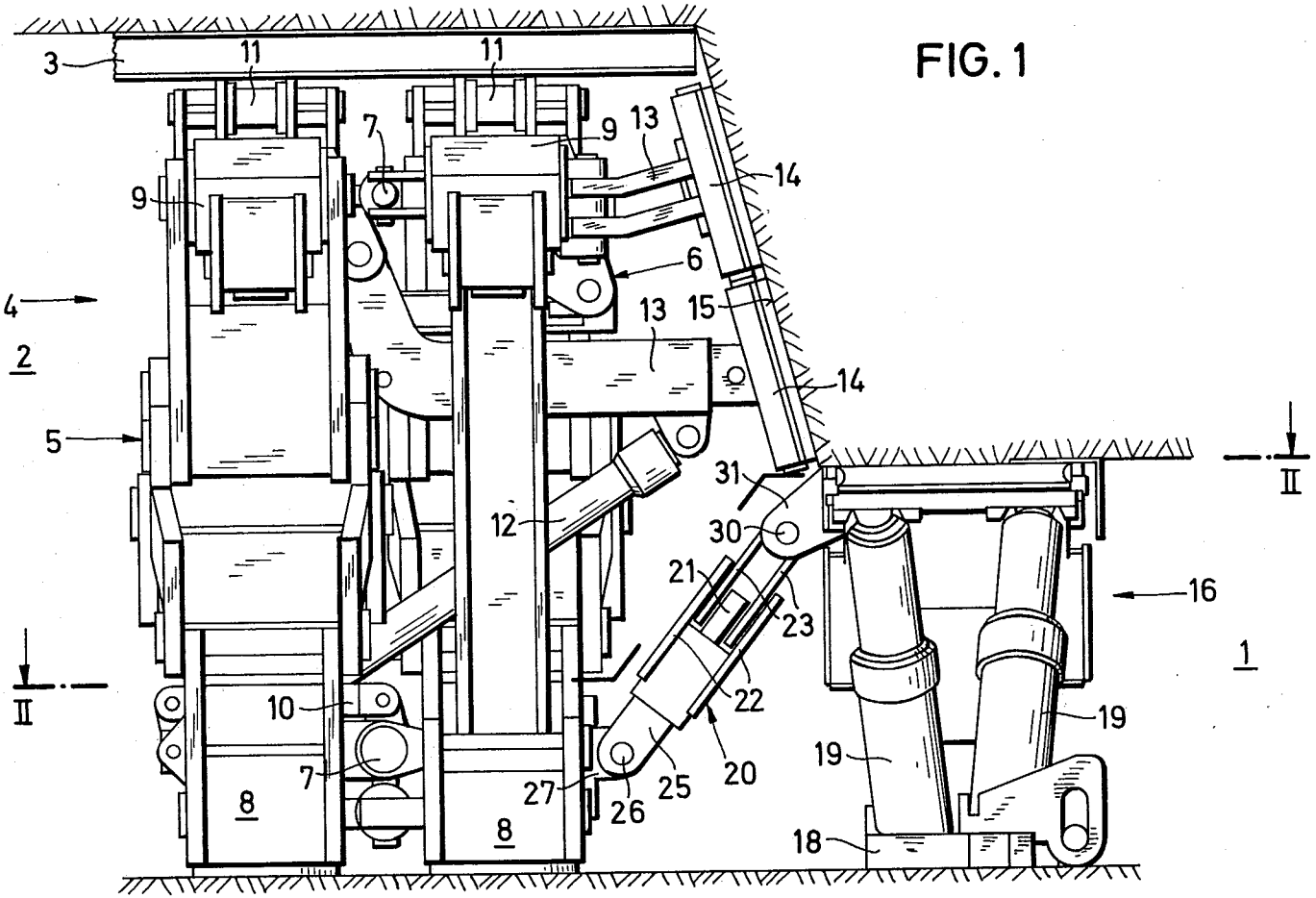
FIG. 1 is a vertical section through the transition area between a mine roadway and a mine face, showing a mine support according to the invention in an endview.

The reference numeral 2 in FIG. 1 designates a roadway (i.e. main gallery) extending substantially normal to the plane of FIG. 1. A face gallery 1 extends substantially at right angles to the roadway 2 and leads to the not-illustrated actual mine face. The roadway 2 is supported against cave-in by a plurality of longitudinally spaced stationary supports of the door-frame type, i.e. having two lateral uprights and a lintel shield 3. For simplicity, only the shield 3 of one of these stationary supports is shown in FIG. 1.

Figure 2:
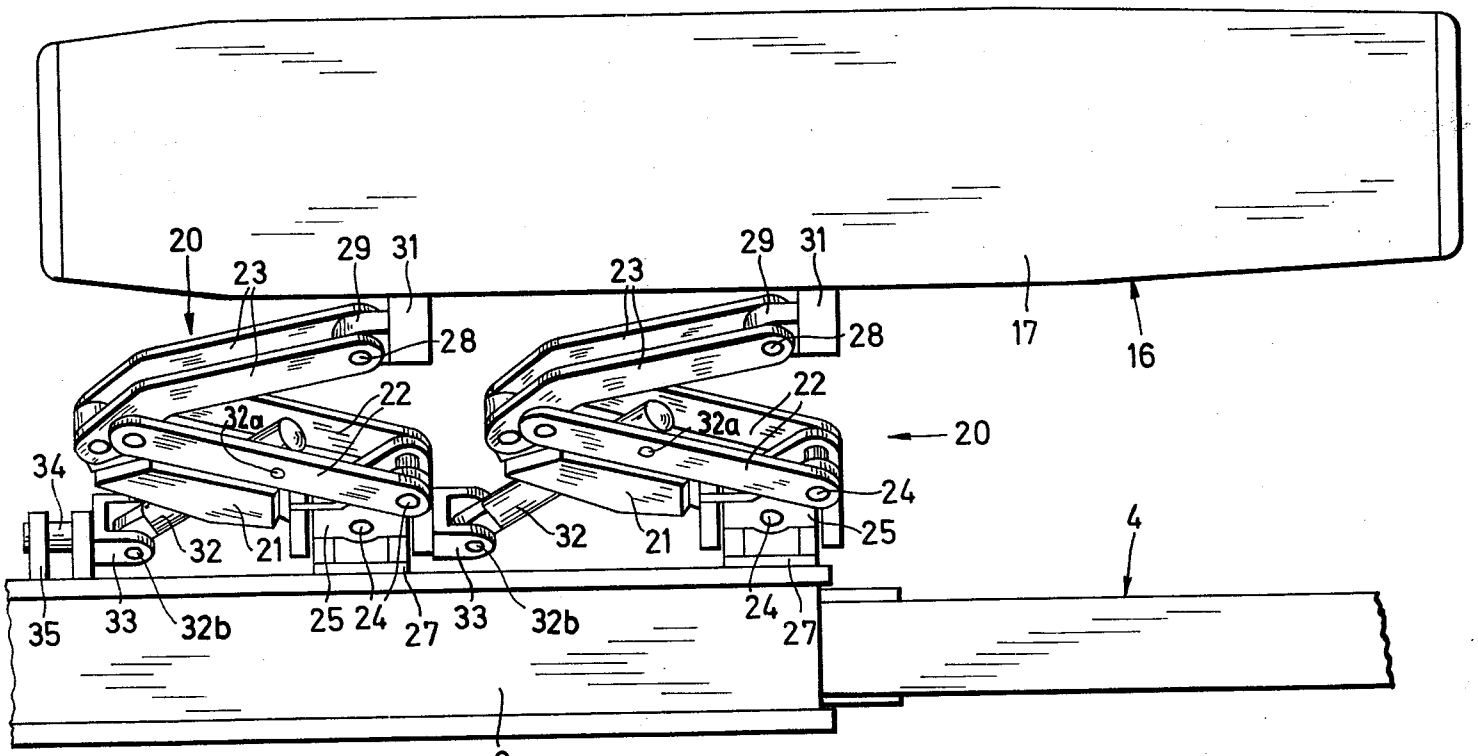
FIG. 2 is a plan view of FIG. 1 as seen from the line II—II and partly shown in section.

As the mining equipment travels along the face gallery 1 (i.e. lengthwise of the roadway 2) the not-illustrated upright stationary supports holding the shields 3 must be removed ahead of it so as not to interfere with its operation; they are reinstalled after the equipment has passed. While they are absent the shields 3 (and hence the overburden) must be supported by auxiliary supporting equipment, e.g. a travelling mine support unit 4 which is shown in FIGS. 1 and 2 as having two frames 5 and 6. These frames are connected with hydraulic rams which alternately move one of the frames (by pushing or pulling, as the case may be) along the roadway 2 while the other frame bears against the shields 3 and thus acts as a bearing for the rams 7. Preferably, such rams 7 are provided in the region of the floor beams 8 and of the roof beams 9 of the unit 4. Additional rams 10 to serve to shift the frames 5 and 6 transversely of the roadway 2 relative to one another. Further, each of the frames 5, 6 is also provided with devices 11 which compensate for gaps between the roof beams 9 and the shields 3, e.g. if the roof beams 9 cannot be extended sufficiently high to bear against the shields. To support the mine face area 15 above the face gallery 1 through which coal is being removed, the frames additionally have lateral shields 14 which can be pressed against the face area 15 by hydraulic rams 12 with which they are connected via appropriate linkages 13.

Extending along the transitional area between face gallery 1 and roadway 2, i.e. in a position to support the undercut resulting from the coal-mining operation in the coal seam, is a seam support unit 16. It has a roof shield 17 and a floor beam 18 which are connected by hydraulic rams 19 via which they can be urged apart, i.e. the shield 17 can be urged upwardly against the roof of the overhang. The rams 19 are arranged in V-formation, in direction transversely to as well as longitudinally of, the face gallery 1. One or more additional ones of the units 16 may be arranged in the gallery 1 inwardly (i.e. in FIG. 1 to the right) of the illustrated unit 16, so as to bridge the distance to the actual mine-face supports (not shown).

Figure 3:
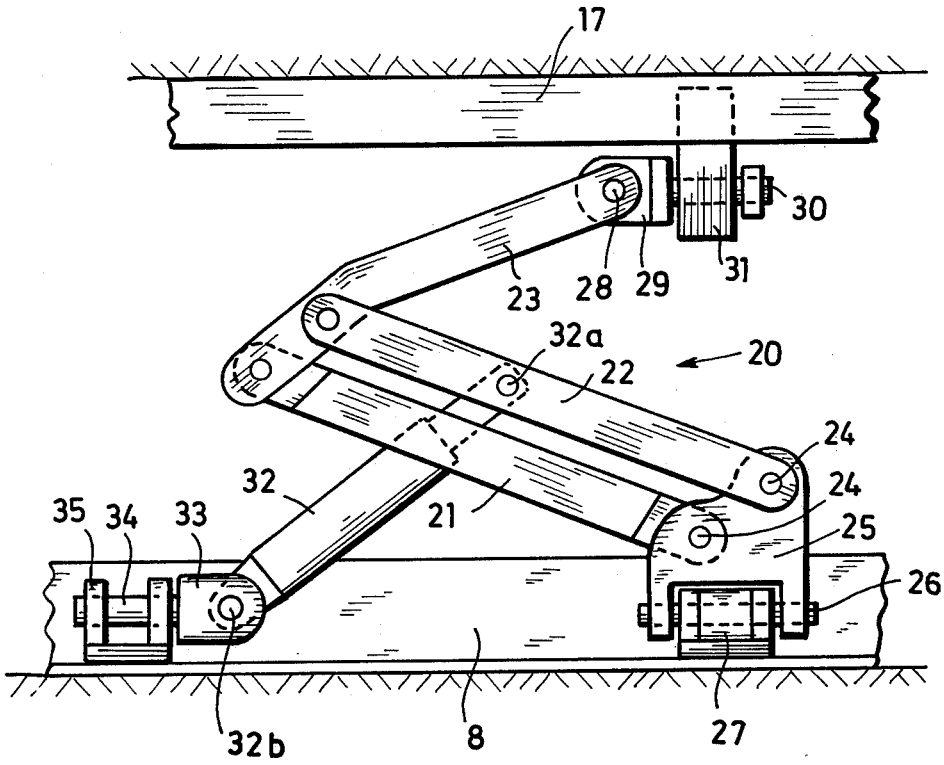
FIG. 3 is an enlarged detail view, showing a coupling used in the embodiment of FIGS. 1 and 2.

In accordance with the invention, and as is evident from a comparison of FIGS. 1 and 2, the unit 4 and the unit 16 are connected with one another by two sequentially arranged four-pivot couplings 20 (see also FIG. 3). These couplings 20 are each composed of two parallel plates 21, two parallel plates 22 and a plate-shaped connector 23. The plates are pivoted via a bolt or pin 24 to a bearing bracket 25 which in turn is pivotally connected with a bearing 27 on the floor beam 8 of the frame 6, by means of a bolt or pin 26 extending lengthwise of the roadway 2. One end of the respective connector 23 is pivoted to the plates 21, 22 and the other end is connected to a bearing bracket 29 via a bolt or pin 28. Bracket 29 is in turn pivotably connected to a bracket 31 on the shield 17 of the unit 16, via a bolt or pin 30 extending lengthwise of the roadway 2.

Accordingly, the components of the couplings 20 have the ability to pivot in direction lengthwise of the roadway 2, as well as to pivot in direction transversely thereto and with reference to both the unit 4 and the unit 16.

Hydraulic rams 32 serve to reinforce and also to displace the couplings 20. For this purpose the rams 32 extend between the plates 21, 22; they are pivoted to the upper plates 22 at **32*a* and at 32*b* to bearing brackets 33. One of the latter is pivotable relative to a bearing 35 on the floor beam 8 of the frame 6, via a bolt or pin 34 which extends lengthwise of the roadway 2. The other bracket 33, namely the one associated with the coupling 20 which is leading in the direction of support advancement (i.e. lengthwise of roadway 2), is pivoted to the bracket 27. The pivot axes of the bolt 26 and 34** coincide with one another.

The unit 16 may be so connected with another similar unit 16 that its floor beam can be shifted from the latter; e.g. a hydraulic ram may connect these units 16 so that one can be pushed or pulled by the ram while the other unit acts as an anchor, and vice versa.

The most important consideration is the specific disclosed arrangement of the couplings 20 since the planes of tilting movement of these couplings extend—according to the invention—in the longitudinal direction of the roadway 2, due to the fact that the pivot axes of the individual plates extend normal to this direction. This permits independent displacement of the unit 16 relative to the unit 4, and vice versa. In addition, it assures that the rather substantial forces resulting from forward movement of the units, especially of the unit 16, are properly absorbed and transmitted to that one of the units which at the particular time serves as the anchor for the moving unit. It is important that the invention makes it possible for the equipment to accommodate itself to variation in spacing and to changes in height, especially of the unit 16. Of course, it goes without saying that instead of two of the couplings 20 it may be possible to use only one or more than two, depending upon conditions in any given application. It will also be understood that the couplings 20 need not necessarily be connected between the roof shield of the unit 16 and the floor beam of the unit 4, although this has been found to be advantageous since it permits maximum freedom in the manipulation of the units 4, 16 relative to one another. The couplings 20 need not necessarily have the illustrated sets of parallel spaced plates 21, 22, although this is advantageous because it permits the rams 32 to be located in the clearance between these plates where they require no additional space and are relatively well protected against damage.

The advantage of providing the couplings 20 with the rams 32 (which could be omitted) is that it permits the roof shield 17 of the unit 16 to be pressed positively and accurately against the roof shield of a support unit (not shown) which is located adjacent to it in direction inwardly of the face gallery. This means that when the unit 16 must be advanced (i.e. "walk"), its floor beams can be lifted and will have much less frictional contact with the floor as they are advanced.

Instead of having the frames 5, 6 arranged adjacent to each other, they may also be nested one inside the other. The wall shields 14 could be omitted but it is preferable to provide them, because they provide support where there would otherwise be none, due to the removal of the lateral uprights of the stationary roadway supports at the face side during passage of the mining equipment. Also, they could be urged into supporting position by equipment other than hydraulic rams, e.g. by screw spindles. The wall shields 14 may be provided on only one or on both of the frames 5, 6; advantageously they are so arranged that while one of the frames 5, 6 is being shifted, the wall shields of the other frame support the wall 15, and vice versa.

While the invention has been illustrated and described as embodied in a walking mine support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A walking mine support for supporting the overburden in the area where a roadway and a face gallery merge with one another, comprising a walking roadway support unit adapted to support at least the roof of the roadway and adapted to advance lengthwise of the latter; a walking face gallery support unit adapted to support the roof of the face gallery and also adapted to advance lengthwise of the roadway; and at least one four-pivot coupling connecting said units with one another and comprising coupling members which are tiltable about mutually inclined axes extending lengthwise of and transverse to the elongation of the roadway, respectively.

2. A walking mine support as defined in claim 1, said roadway support unit having a floor beam and said face gallery support unit having a roof shield, and wherein said coupling is connected between said floor beam and said roof shield.

3. A walking mine support as defined in claim 2, wherein said coupling has links which are pivotable relative to one another and are pivoted to said floor beam, and a connector pivoted to said couplings and to said roof shield.

4. A walking mine support as defined in claim 3, said coupling further comprising a hydraulic ram pivotably connected to said coupling.

5. A walking mine support as defined in claim 3, said coupling further comprising a hydraulic ram pivotably connected to some of said links and to said floor beam, respectively.

6. A walking mine support as defined in claim 4; and further comprising substantially horizontal shafts on the respective units and extending lengthwise of the roadway, and means on said coupling connecting the same to said shafts for pivoting about the same in an upright plane.

7. A walking mine support as defined in claim 1, said roadway support unit comprising two adjacent supporting frames which are engageable with stationary supports installed in the roadway, and hydraulic rams connected between said frames for moving the same relative to one another.

8. A walking mine support as defined in claim 1, said roadway support unit comprising at least one lateral wall supporting shield, and means for pressing the same against the face-side wall of the roadway.

* * * * *